United States Patent [19]

Helpiö

[11] Patent Number: 4,693,202

[45] Date of Patent: Sep. 15, 1987

[54] FREEZE RESISTANT BOTTOM WELL

[75] Inventor: Pentti K. Helpiö, Uusikaupunki, Finland

[73] Assignee: Rauma-Repola OY, Uusikaupunki, Finland

[21] Appl. No.: 789,488

[22] Filed: Oct. 21, 1985

[30] Foreign Application Priority Data

May 13, 1985 [FI] Finland ..... 851880

[51] Int. Cl.[4] ..... B63B 25/08

[52] U.S. Cl. ..... 114/74 A; 138/28

[58] Field of Search ..... 114/74 R, 74 A, 126, 114/198, 40–43, 182, 183 R; 138/27, 28; 137/59; 220/85 B

[56] References Cited

U.S. PATENT DOCUMENTS 1,381,426 6/1921 Parker ..... 138/27
1,927,105 9/1933 Welch ..... 138/27
2,273,505 2/1942 Florian ..... 138/28
4,215,726 8/1980 Tagami ..... 138/28
4,313,390 2/1982 Yunoki et al. ..... 114/125

*Primary Examiner*—Jeffrey V. Nase
*Assistant Examiner*—Jesûs D. Sotelo
*Attorney, Agent, or Firm*—Ladas & Parry

[57] ABSTRACT

A bottom well of a vessel having at least one of a bottom and a broad side has a wall and cover-plate structure attached to the bottom or broad side for, together, defining the bottom wall. An inner space within the bottom well of the vessel has inside surfaces. A water inlet is in one of the bottom or broad side for communication of the inner space with outside water. A water outlet is in one of the wall and cover-plate structure for communication of the inner space with systems of the vessel. At least one resilient body is in the inner space for compensating for volume changes of water in the bottom well caused by the water freezing in the bottom well.

5 Claims, 2 Drawing Figures

FREEZE RESISTANT BOTTOM WELL

The invention relates to a freeze resistant bottom well of a vessel.

A bottom well of a vessel is a box-like structure within the frame of the vessel, which, in operating conditions, is below the water surface, i.e. water line. When containing water, the cooling water for the machines of the vessel, the ballast water, the flush water of the sewage system, etc. are obtained by pumping water from the well.

The bottom wells of vessels are usually positioned at the side of the vessel or under the bottom thereof in such a manner that a bottom well wall provided with an inlet and a screen is towards the outside water. The other walls are inside the vessel, whereby they usually extend in level with or above the double bottom (a so called ice well). Thus the bottom well is a kind of container positioned within the vessel, the volume of which can be several cubic meters and which is in open communication with the water surrounding the vessel.

A disadvantage of previously known bottom well constructions has been poor usability in artic conditions, particularly when the vessel is kept cold over the winter. Thereby freezing in the bottom wells causes damage, because water expands on freezing, specifically swelling and breaking of the bottom wells.

The following ways, for instance, are previously known in protecting bottom wells against freezing:

The most usual way has been to pump oil into the bottom well, which, however, is ecologically disadvantageous and requires inconvenient cleaning work when the well is again put into use.

The inlet of the bottom well is covered, thus preventing water from coming into the well. Thereafter the well is sucked empty. After the inlet has been covered, the bottom well can be filled with an anti-freezing liquid or oil.

A thermal isolation can be constructed around the bottom well and the well can be heated by means of electric resistances or the like.

Further, the construction of the bottom well can be sufficient that the well endures freezing.

By means of a bottom well according to the invention, any disadvantages and damages caused by freezing are eliminated. The bottom well does not need to be heated, emptied or filled with oil or the like in order to prevent freezing. The bottom well does not require any maintenance. The bottom well of a vessel standing cold in ice does not need to be watched over.

Tests carried out have shown that a bottom well set up of shipbuilding plates does not endure freezing, the expansion of water on freezing causing permanent deformations in the steel structures. As distinctive therefrom the bottom well according to the invention endures freezing well, the walls of said well being covered with a resilient material, such as Neoprene closed cell rubber.

Figure 1:
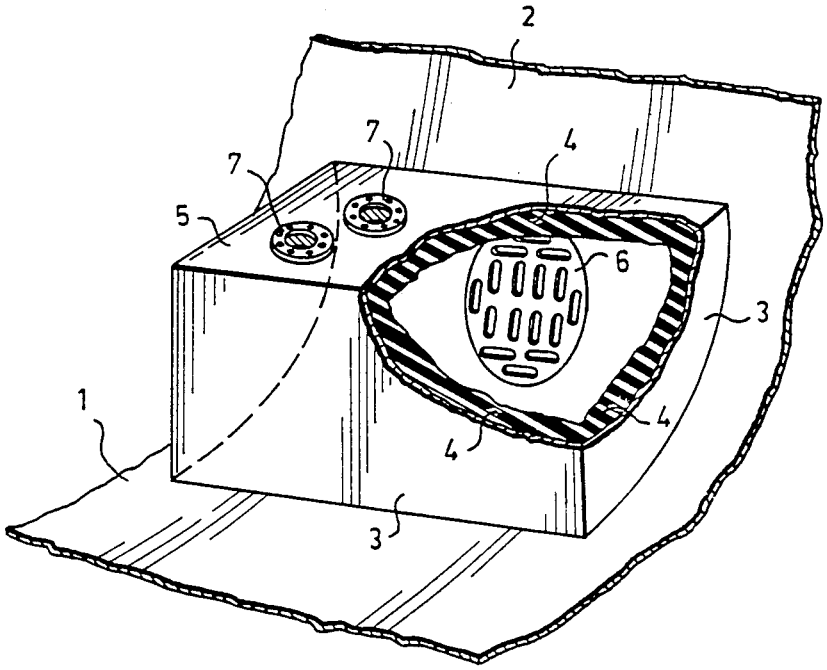
FIG. 1 shows a partial cut-away view illustrating one embodiment of the invention.
Figure 2:
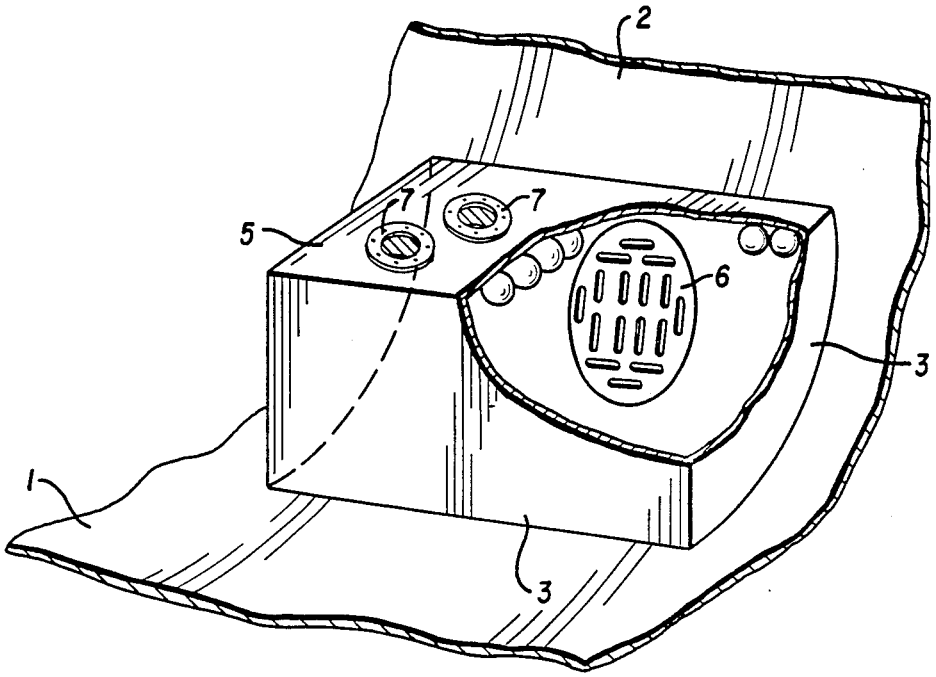
FIG. 2 shows an embodiment of the invention wherein the resilient bodies are positioned within the inner space.

In FIG. 1, the numeral 1 designates a bottom of a vessel. The numeral 2 refers to a broad side of the vessel. Walls of the bottom well are indicated by the numeral 3. The resilient lining material of the inner surfaces of the bottom well is indicated by the numeral 4. A cover plate of the bottom well is the numeral 5. A water inlet is shown by the numeral 6 and tube connections, i.e. outlets, by the numeral 7.

The resilient lining of the walls of the bottom well must be sufficiently thick so as to allow free expansion of freezing water without damaging the structures of the bottom well.

The above description and the drawing related thereto are intended to illustrate the inventive idea. The different embodiments of the invention may, of course, vary within the scope of the claims presented below. So the bottom well can have another shape and the inlets can be positioned as different places. The volume change caused by freezing can also be compensated by using resilient particles or bodies independently in the bottom well. Said particles or bodies can be, for instance, rubber balls or bodies of another shape. The amount of said rubber balls or like depends on their size because the amount of resilient material must be sufficient so as to allow free expansion of freezing water without damaging the structures of the bottom well. The resilient lining may cover all the inner surfaces of the bottom well as described earlier, but it is also possible to cover, for instance, only certain parts of the inner surfaces with a resilient material etc.

What is claimed is:

1. A bottom well of a vessel, comprising:

at least one of a bottom and a broad side of a vessel;

a wall and cover-plate structure attached to the at least one of the bottom and broad side for together defining a bottom well having an inner space within inside surfaces thereof;

a water inlet in one of the at least one of the bottom and broad side for communication of the inner space with outside water;

a water outlet in one of the wall and cover-plate structure for communication of the inner space with systems of the vessel; and means comprising at least one resilient body in the inner space for compensating for volume changes of water in the bottom well caused by the water freezing in the bottom well.

2. The bottom well according to claim 1, wherein the at least one resilient body comprises a lining covering the inside surfaces of the wall and cover-plate structure.

3. The bottom well according to claim 1, wherein the at least one resilient body is within the innser space but independent of the inside surfaces thereof.

4. The bottom well according to claim 3, wherein said body has a spherical configuration.

5. The bottom well according to claim 1, wherein the outlet is in the cover plate of the wall and cover-plate structure.

* * * * *